US010988280B2

(12) United States Patent
Estabrook et al.

(10) Patent No.: US 10,988,280 B2
(45) Date of Patent: Apr. 27, 2021

(54) SECONDARY INSERTION FEATURE FOR ASSEMBLED PACKAGE

(71) Applicant: BEDFORD SYSTEMS LLC, Bedford, MA (US)

(72) Inventors: Richard M. Estabrook, Waterbury, VT (US); Matthew Elmer, Ardmore, PA (US)

(73) Assignee: Bedford Systems LLC, Bedford, MA (US)

( * ) Notice: Subject to any disclaimer, the term of this patent is extended or adjusted under 35 U.S.C. 154(b) by 0 days.

(21) Appl. No.: 16/129,500

(22) Filed: Sep. 12, 2018

(65) Prior Publication Data

US 2019/0077540 A1 Mar. 14, 2019

Related U.S. Application Data

(60) Provisional application No. 62/557,348, filed on Sep. 12, 2017.

(51) Int. Cl.
*B65D 5/42* (2006.01)
*B65D 77/04* (2006.01)
(Continued)

(52) U.S. Cl.
CPC ..... *B65D 5/4204* (2013.01); *B65D 5/48024* (2013.01); *B65D 77/0413* (2013.01); *B65D 85/68* (2013.01); *B65D 2585/6815* (2013.01)

(58) Field of Classification Search
CPC ..... B65D 5/4204; B65D 5/48024; B65D 77/0413; B65D 85/68; B65D 5/16; A47F 5/11
(Continued)

(56) References Cited

U.S. PATENT DOCUMENTS 1,670,498 A * 5/1928 Einson ..... B65D 5/4204 229/120.01
2,643,811 A 6/1953 Velman
(Continued)

FOREIGN PATENT DOCUMENTS

CN 205499654 U 8/2016
EP 1582571 A1 10/2005
(Continued)

OTHER PUBLICATIONS

International Search Report and Written Opinion for International Patent Application No. PCT/US2018/050720 dated Dec. 3, 2018.
(Continued)

*Primary Examiner* — Christopher R Demeree
(74) *Attorney, Agent, or Firm* — Dorsey & Whitney LLP

(57) ABSTRACT

The present exemplary system and method relates to a feature upon the exterior of a corrugated package that allows an access secondary to the primary opening feature for the inclusion of sample materials that are added after the package has been sealed at the contents' (e.g., appliance) place of manufacture. The benefits of the invention are reduced unit operations and labor to include sample materials. Additionally, the packaging feature will deter theft of sample materials from the product to the point of sale. The theft deterrence is achieved via a tamper-evident label covering the feature after sample materials have been inserted.

19 Claims, 8 Drawing Sheets

(51) Int. Cl.
*B65D 5/49* (2006.01)
*B65D 85/68* (2006.01)

(58) Field of Classification Search
USPC ..... 229/120.37, 120.15, 242, 120.18, 122, 229/120.03, 121; 221/34; 206/589, 419; 312/259; 220/23.87, 525, 529
See application file for complete search history.

(56) References Cited

U.S. PATENT DOCUMENTS 3,039,671 A 6/1962 Chiamardas
3,058,619 A * 10/1962 Jaeschke ..... A47F 1/085 221/305
3,066,843 A * 12/1962 Johnson ..... B65D 5/16 221/70
3,309,206 A * 3/1967 Daniels ..... B65D 5/16 426/115
3,872,966 A * 3/1975 Gordon ..... B65D 5/4204 206/772
4,186,866 A * 2/1980 Zicko ..... B65D 5/722 229/122.1
4,767,022 A * 8/1988 Oldorf ..... G07F 11/18 221/191
4,967,910 A 11/1990 Schuster
5,067,609 A * 11/1991 Stout ..... B65D 5/4204 206/216
5,328,082 A * 7/1994 Fritz ..... B65D 5/724 221/302
5,370,220 A * 12/1994 Wang ..... A47F 1/08 206/499
5,372,278 A * 12/1994 Leight ..... B65D 83/04 221/174
5,570,808 A * 11/1996 Tassoni ..... A47F 1/08 221/311
5,938,109 A * 8/1999 Sainz ..... B65D 5/48014 229/120.11
6,915,907 B2 7/2005 Myers
7,584,854 B2 * 9/2009 Chandaria ..... B65D 5/5038 206/391
8,348,053 B2 1/2013 Bellamah et al.
10,351,292 B2 * 7/2019 Wishon ..... B65D 5/4237
2007/0170090 A1 7/2007 Po et al.
2009/0000966 A1 1/2009 Baranowski
2011/0155796 A1 6/2011 Moore et al.

FOREIGN PATENT DOCUMENTS

JP 2006282223 A 10/2006
JP 2018104097 A 7/2018
WO 2010037529 A1 4/2010
WO 2014085625 A1 6/2014

OTHER PUBLICATIONS

Machine translation of Description, Claims and Abstract of Japanese Application No. 2006282223.

* cited by examiner

SECONDARY INSERTION FEATURE FOR ASSEMBLED PACKAGE

RELATED APPLICATIONS

This application claims the benefit of priority under 35 U.S.C. § 119 of U.S. Provisional Application Ser. No. 62/557,348 filed on 12 Sep. 2017, titled "Secondary Insertion Feature for Assembled Package", the entire contents of which is hereby incorporated by reference in its entirety.

FIELD

The present disclosure relates generally to packaging systems, and more specifically to a utility feature for inserting adjunct and/or essential materials within an assembled corrugated package.

BACKGROUND

Historically, small consumer appliances and other fully assembled machines (e.g., Keurig coffee makers) are manufactured in countries with reduced manufacturing and labor costs (such as Asia or Mexico), are packaged, and are then shipped to the United States or another country for distribution. Prior to shipment to final retail locations, sample materials or adjunct components, such as ingredients, supplies, or beverage pods (produced in North America) are included within the appliance package.

Traditional appliance packaging designs require a disassembly of the pallet load of appliances, re-opening of the appliance's typically corrugated package, insertion of the sample or adjunct materials, resealing of the appliance packaging, and reassembly of the pallet load for further processing and delivery. This process consumes a high degree of both time and labor.

Further, manufacturing constraints, such as location, distribution channels, and existing manufacturing assemblies, often discourage (i) shipping sample materials or adjunct components to Asia, Mexico, or other appliance manufacturing centers because efficient use of a finite shelf-life of product is not always accomplished due to inefficient logistics, or (ii) a process with few unit operations or limited labor to include sample materials.

Therefore, there is a need for an efficient and economical way to add sample materials or adjunct components to a factory sealed primary packaging.

SUMMARY

An exemplary embodiment of the present system and method overcomes the above-mentioned disadvantages and meets the recognized need for such a device by providing an opening feature upon an exterior wall of a primary package which provides the utility of inserting adjunct and/or essential materials without requiring the opening of the primary (major or minor) flaps of the primary packaging. The exemplary system and method includes a hinged door on the outer surface of the primary package that is re-closable.

In a first aspect, the present disclosure includes a package. The package includes a primary packaging. The primary package includes walls that define an interior space configured to hold primary contents. The primary package further includes a primary access flap that is configured to enclose the primary contents within the interior space. The package further includes an opening feature defined in an outer surface of at least one wall of the primary packaging and configured to provide access to the interior space for adjunct materials. The opening feature is configured to provide access to the interior space for adjunct materials while the primary packaging maintains: (i) the primary access flap in a closed position; and (ii) a position of primary contents held within the interior space.

A number of feature refinements and additional features are applicable in the first aspect and contemplated in light of the present disclosure. These feature refinements and additional features may be used individually or in any combination. As such, each of the following features that will be discussed may be, but are not required to be, used with any other feature combination of the first aspect.

In an embodiment, the opening feature includes a hinged door configured to articulate over a secondary opening defined in the outer surface. The packaging may further include an internal feature defining an internal compartment within the interior space and connected to the secondary opening defined by the outer surface.

In another embodiment, the adjunct material may be arranged within a secondary packaging. The internal compartment may be configured to receive the secondary packaging. In some cases, the internal feature is configured to define a friction fit with an exterior of the secondary packaging.

In another embodiment, the primary contents may be an appliance comprising a beverage machine. The adjunct materials may be consumables associate with an operation of the beverage machine.

In some cases, the package may further include the primary contents. The primary packaging may be formed from a corrugated material.

In a second aspect the present disclosure includes a package. The package includes walls formed from a corrugated material and defining an interior space. The package further includes a primary access flap enclosing the interior space. The package further includes at least one wall defining a secondary opening in an outer surface extending into the interior space. The at least one wall further defines a hinged door covering the secondary opening. The interior space is arranged to receive adjunct materials through the secondary opening. The primary access flap, when opened, allows for access to adjunct materials.

A number of feature refinements and additional features are applicable in the second aspect and contemplated in light of the present disclosure. These feature refinements and additional features may be used individually or in any combination. As such, each of the following features that will be discussed may be, but are not required to be, used with any other feature combination of the second aspect.

In an embodiment, the hinged door may be defined by perforations formed through the at least one wall. The hinged door may be configured to separate from a remainder of the at least one wall along the perforations. The hinged door may define a digit engagement feature configured for manipulation of the hinged door.

In another embodiment, the packaging comprises an internal feature configured to separate primary contents held within the interior space from adjunct materials received through the secondary opening. In some cases, the interior space may be configured to hold primary contents in a predetermined orientation. The predetermined orientation of the primary contents is maintained when adjunct materials are received through the secondary opening.

In another embodiment, the packing comprises a sealer configured to seal the hinged door about the opening.

In a third aspect the present disclosure includes a method for assembling a package. The method includes providing a primary package defining an interior space, the primary package including a primary access flap and an opening feature, each connected to the interior space. The method further includes packaging primary contents with the primary package at a predetermined orientation by: (i) inserting the primary contents into the interior space through the primary access flap; and (ii) sealing the primary access flap. The method further includes packaging adjunct materials with the primary package by inserting the adjunct materials into the interior space through the opening feature, while maintaining the predetermined orientation of the primary contents within the interior space.

A number of feature refinements and additional features are applicable in the third aspect and contemplated in light of the present disclosure. These feature refinements and additional features may be used individually or in any combination. As such, each of the following features that will be discussed may be, but are not required to be, used with any other feature combination of the first aspect.

In an embodiment, the operation of providing a primary package further includes forming the opening feature in a wall of the primary packaging defining the interior space by one or more of die-cutting, laser-cutting, or stamping.

In another embodiment, the opening feature includes a hinged door defined by perforations formed through a wall of the primary packing defining the interior space. In some cases, the operation of packaging the adjunct materials further includes separating the hinged door from a remainder of the wall along the perforations.

In another embodiment, the method further includes sealing the opening feature using tamper-resistant tape.

In addition to the exemplary aspects and embodiments described above, further aspects and embodiments will become apparent by reference to the drawings and by study of the following description.

BRIEF DESCRIPTION OF THE DRAWINGS

The disclosure will be readily understood by the following detailed description in conjunction with the accompanying drawings, wherein like reference numerals designate like structural elements, and in which.

Figure 1A:
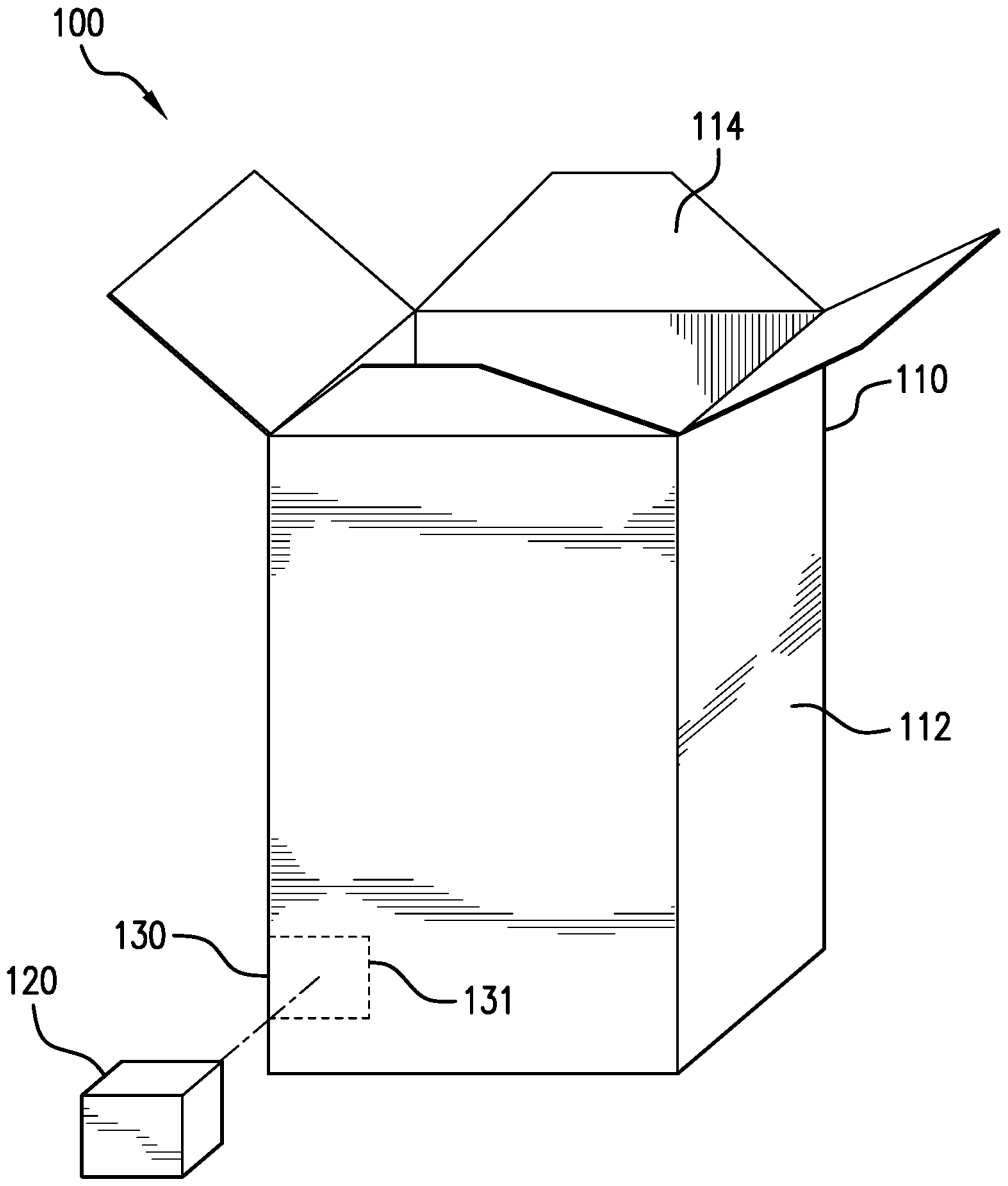
FIG. 1A depicts a perspective view of a packaging system.

The use of cross-hatching or shading in the accompanying figures is generally provided to clarify the boundaries between adjacent elements and also to facilitate legibility of the figures. Accordingly, neither the presence nor the absence of cross-hatching or shading conveys or indicates any preference or requirement for particular materials, material properties, element proportions, element dimensions, commonalities of similarly illustrated elements, or any other characteristic, attribute, or property for any element illustrated in the accompanying figures.

Additionally, it should be understood that the proportions and dimensions (either relative or absolute) of the various features and elements (and collections and groupings thereof) and the boundaries, separations, and positional relationships presented therebetween, are provided in the accompanying figures merely to facilitate an understanding of the various embodiments described herein and, accordingly, may not necessarily be presented or illustrated to scale, and are not intended to indicate any preference or requirement for an illustrated embodiment to the exclusion of embodiments described with reference thereto.

DETAILED DESCRIPTION

The description that follows includes sample systems, methods, and apparatuses that embody various elements of the present disclosure. However, it should be understood that the described disclosure may be practiced in a variety of forms in addition to those described herein.

The present disclosure describes systems, devices, and techniques related to systems for accessing the interior portion of a primary package after assembly, perhaps at a different location than the initial assembly. This allows for the convenient and undisruptive insertion of secondary packages, samples, components, and the like. This is particularly advantageous when the secondary packages, samples, components, and the like are perishable items or items that have a limited shelf-life. According to one exemplary embodiment, the system for accessing the interior portion of a primary package after assembly includes a die-cut and hinged "trap door" which enables access to the interior of the package, is re-closable, and is die-cut into an exterior wall of the primary container.

Systems and methods described herein are presented in the context of the packaging of an appliance such as a Keurig coffee maker, or other beverage machine, including beverage machines for the production of alcoholic beverages, but can be applied to any number of manufactured articles that are manufactured and packaged at a remote location from the final distribution center. Additionally, the systems and methods may be used with any manufactured article that may be manufactured and packaged prior to final shipment, but that would benefit from the insertion of a perishable item or an item that has a lower shelf-life than the likely storage time of the manufactured item, prior to final shipping.

Reference will now be made to the accompanying drawings, which assist in illustrating various features of the present disclosure. The following description is presented for purposes of illustration and description. Furthermore, the description is not intended to limit the inventive aspects to the forms disclosed herein. Consequently, variations and modifications commensurate with the following teachings, and skill and knowledge of the relevant art, are within the scope of the present inventive aspects.

FIG. 1A illustrates an appliance packaging system 100 (or more generally referred to herein as a "package"), according to one embodiment. As shown, the appliance packaging system 100 or package may include a primary packaging 110 and a secondary packaging 120. The illustrated primary packaging 110 is configured to house a manufactured article, such as an appliance (e.g., a beverage machine), after its manufacture and assembly. Often, the manufacture and assembly of the appliance is performed some distance from the ultimate shipping and distribution center. Consequently, the primary packaging 110 may be assembled, packaged with the appliance, and sealed for distribution from the primary assembly location.

The illustrated secondary packaging 120 is configured to house adjunct materials associated with the appliance. The adjunct materials may be consumables associated with an operation of the appliance. Possible consumables include beverage pods or other consumables that have a defined shelf-life, including various teas, coffees, alcohols, soups, carbonation cartridges, and variations and derivatives thereof.

The packaging system 100 may operate to allow for insertion of the secondary package 120 into an interior space of the primary package 110, without opening a primary access flap or other opening that is configured for the assembled appliance. In this regard, the adjunct materials of the secondary packaging 120 may be added to the interior space of the primary packaging 110 without disturbing the appliance or other primary contents of the primary packaging. The primary packaging 110 may therefore maintain a position, orientation, assemblage, and so on of the appliance or other primary contents within the interior space while the secondary packaging 120 is advanced into the primary packaging 110. The secondary packaging 120 is therefore inserted into the primary packaging 110 in an efficient and economical manner that may avoid repackaging or other rework associated with the appliance packaged in the primary package 110.

It will be appreciated that the primary and secondary packages described herein may be constructed in a variety of shapes, sizes, and from a variety of different materials, in order to accommodate the contents being packaged. In the example of FIG. 1A, the primary packaging 110 is shown generally as a rectangular prism or cuboid shape. The primary packaging 110 includes walls 112. The walls 112 may be structural walls that define an interior space of the primary package 110. The walls 112 may have a thickness that provides structural support for the primary packaging 110 (and optionally for the secondary packaging 120), while also providing protection for primary contents held therein.

The primary packaging 110 also includes a primary access flap 114, shown in FIG. 1A. The primary access flap 114 is configured to provide access to an interior space of the primary package 110. For example, the primary access flap 114 may include hinged panels or other features that articulate over a primary opening defined by the primary packaging 110. Primary contents for packaging in the interior spaces (e.g., an appliance, including a beverage making machine) may generally be advanced into the primary opening, for example, when the primary access flap 114 is in an open configuration (such as that shown in FIG. 1A). The primary access flap 114 may therefore have a size, shape, contour, and so forth that allow the primary contents to be advanced into the interior space, while also being able to cover the primary opening, and enclose the primary contents within the interior space.

The primary package 110 and secondary packaging 120 may be formed of any appropriate material used for packaging of appliances or other manufactured and/or associated articles. According to one exemplary embodiment, cardboard, a polymer, paper, cardstock, a laminate material, a composite based material, and the like may be used. In some cases, a corrugated material may be used to provide additional structural stiffness to the resulting packaging structures, or portions thereof.

The packaging system 100 may generally include an opening feature to allow for the convenient and undisruptive insertion of secondary packaging, for example, subsequent to packaging and shipping primary contents, including an appliance. In the embodiment of FIG. 1A, an opening feature 130 is shown on one of the walls 112 that define the interior space of the primary package 110. The opening feature 130 may broadly be any appropriate structure or assembly or subassembly of components that allow for access into the interior space of the primary package 110, for example, without opening the primary access flap 114.

The opening feature 130 is shown in the example illustrated embodiments as a hinged door defined, in part, by perforations 131 formed through one or more of the walls 112. It will be appreciated that the opening feature 130 may also include, or be, various other doors, seals, locks, sliding features, windows, screens, and so forth, to facilitate the functionality of the opening feature 130 described herein.

Broadly, the opening feature 130 provides the utility of inserting adjunct and/or essential materials at a location separate from the primary assembly location without requiring the opening of the primary (major or minor) flaps (e.g., primary flap 114) of the primary packaging 110. The adjunct and/or essential materials may be free or may, alternatively, be contained within the secondary packaging 120.

As described herein, the opening feature 130 may be a hinged door formed by one or more of the walls 112 of the primary package 110. For example, a portion of the walls 112 may include the perforations 131 that extend substantially through a thickness of the wall 112. The perforations 131 may extend along three distinct, and connected lines, such as that shown in FIG. 1A. A portion of the walls 112 may be separated from a remainder of the wall 112 along the perforations 131, and thus be allowed to articulate along a non-perforated, or hinged edge.

According to one exemplary embodiment, the perforations 131 formed through the wall 112 of the primary packaging 110 are die-cut into the exterior wall of the primary package 110 prior to assembly. Alternatively, the perforations 131 may be formed of any number of manufacturing methods, including, but in no way limited to, laser cutting, punching, pressing, stamping, and so on. Furthermore, the perforations 131 may be formed through the wall 112 of the primary packaging 110 after the assembly of the primary package 112, such as in an assembly-line manufacturing process.

The opening feature 130 described herein may generally be re-closable or re-sealable. For example, the opening feature 130 is configured to articulate over a secondary opening, thereby allowing for insertion of the secondary packaging 120 into the interior space of the primary packaging 110. Subsequent to insertion of the secondary packaging 120, the opening feature may further be articulated to cover the secondary opening, and enclose the secondary packaging 120 within the interior space of the primary packaging 110.

According to one embodiment, the adjunct or sample materials are housed in the secondary package 120. Alternatively, the adjunct or sample materials may be inserted into the primary packaging 110 via the opening feature 130 without being housed in the secondary packaging 120, wherein they will be loose articles within the primary packaging 110.

As illustrated, the secondary package 120 can be sized to securely pass through the opening feature 130, when it is opened. For example, as described in greater detail below, one or more internal features of the primary packaging 110, such as a shelf, a divider, an internal wall, and so forth, may define a compartment or other feature that retains the secondary packaging 120 within the interior space of the primary packaging. In some cases, this interior feature may help establish a friction fit with the secondary packaging 120, for example, in order to retain the secondary packaging securely within the interior space. Alternatively, the secondary packaging 120 or the loose adjunct or sample materials may be significantly smaller than the opening defined by the perforated door 130.

As described above, FIG. 1A generally depicts the packaging system 100 in an example open configuration. For example, in FIG. 1A, the primary access flaps 114 are open and the secondary packaging 120 is removed from the interior space of the primary packaging 110.

Figure 1B:
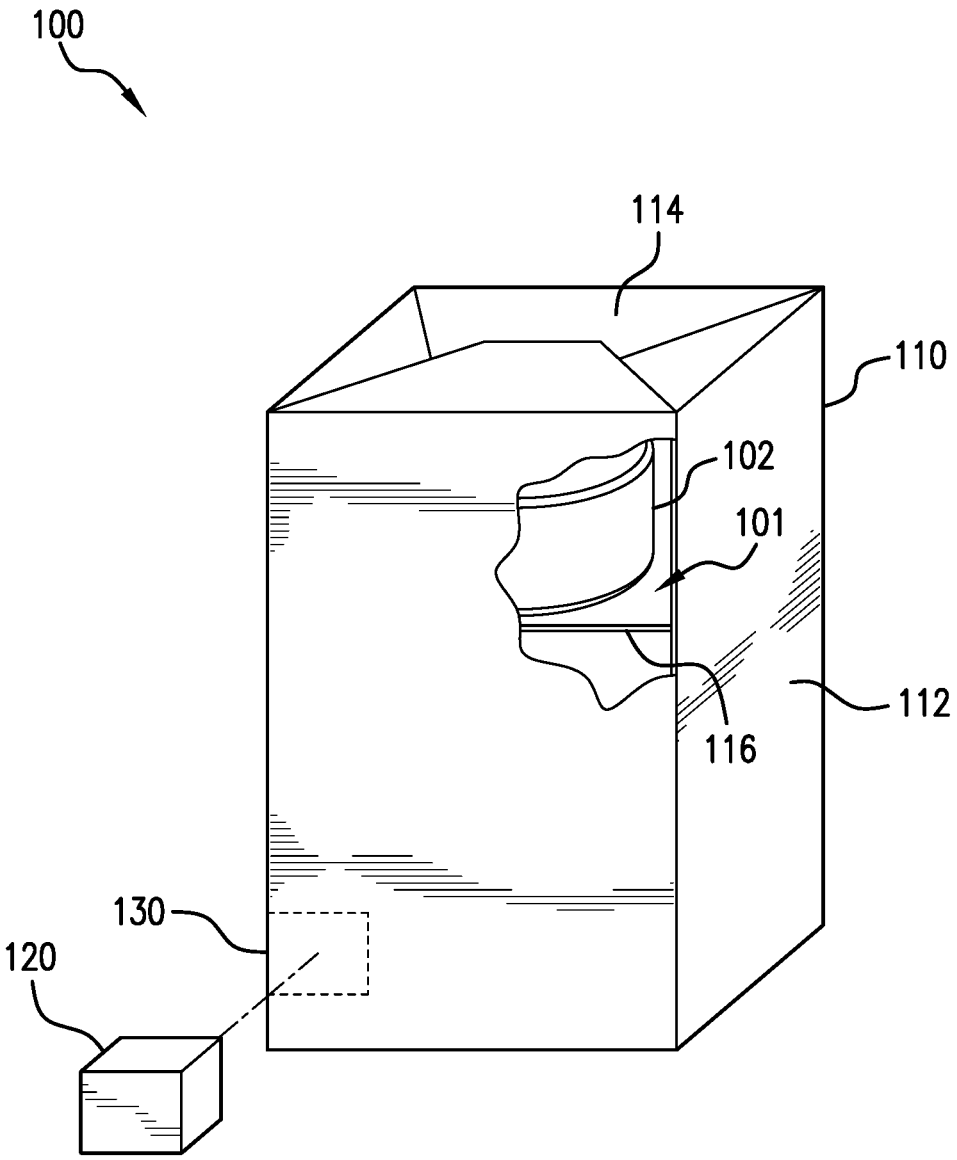
FIG. 1B depicts the packaging system of FIG. 1A having enclosed primary contents, as shown by a partial cut-away view of a primary packaging.

With reference to FIG. 1B, the packaging system 100 is shown in a configuration in which primary contents are enclosed in an interior space of the primary package 110. For example, FIG. 1B illustrates sample primary contents 102 held within an interior space 101 of the primary packaging 110. The primary contents 102 may be an appliance, such as a beverage making machine, as described herein. In other cases, the primary contents 102 may be other assembled devices, appliances, apparatus, and so forth that may be manufactured remotely.

The primary contents 102 are shown in FIG. 1B generally supported within the interior space 102 by an internal feature 116. The internal feature 116 may be an internal shelf, wall, support, divider, and so on. The internal feature 116 and/or other structure of the primary packaging 110 may help maintain a position or orientation of the primary contents 102. The internal feature 116 may also help separate the primary contents from a portion or compartment of the primary packaging 110 that is configured to receive the secondary packaging 120. And as such, a position of the interior space of the primary packaging may be dedicated or reserved for the secondary packaging or loose adjunct materials. In part because the secondary packaging 120 may have its own dedicated portion of the internal space, the secondary packaging 120 may be inserted into the primary packaging without disturbing the position or orientation of the primary contents held therein. This functionality, allows the primary contents 102 to be assembled and package in final form (e.g., fully assembled, packaged) remotely, despite the subsequent addition of the secondary packaging 120.

Figure 1C:
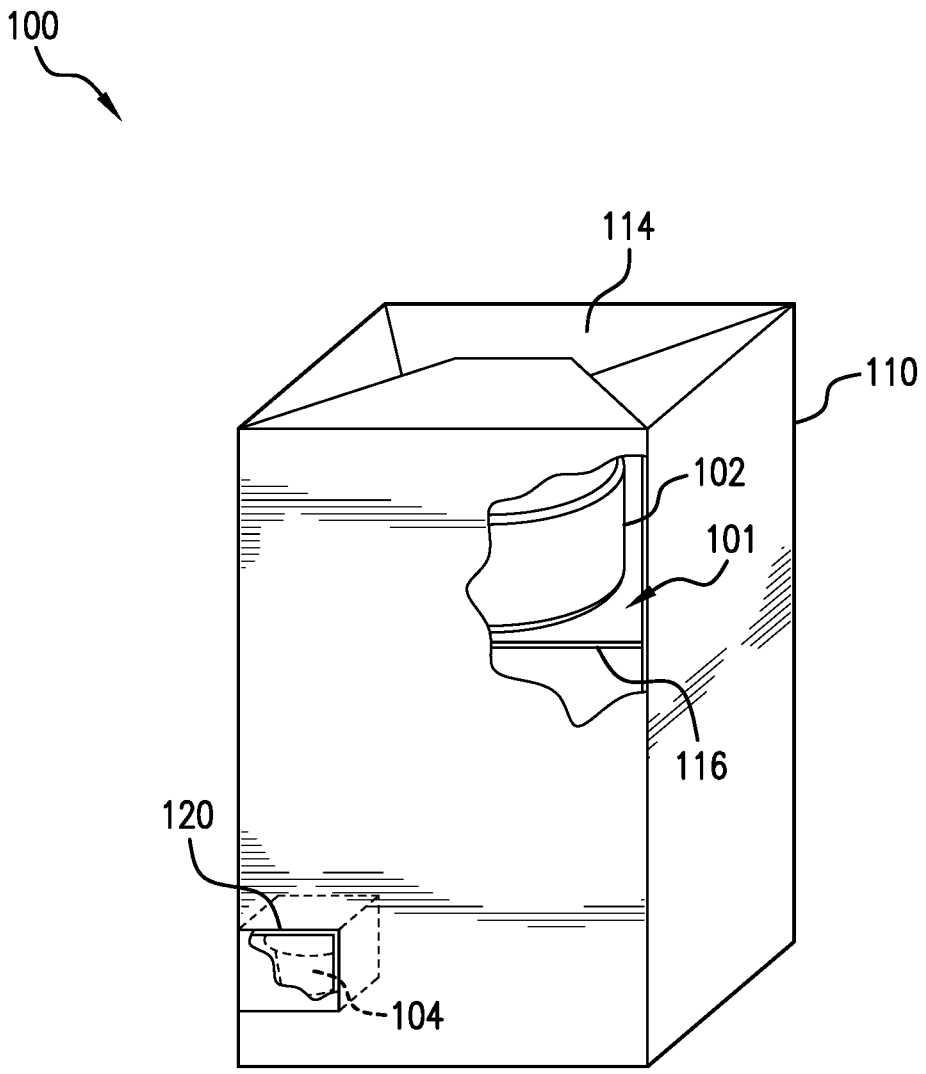
FIG. 1C depicts the packaging system of FIG. 1B having enclosed adjunct contents, as shown by a partial cut-away view of a secondary packaging received by the primary packaging.

With reference to FIG. 1C, the packaging system 100 is shown in a configuration in which the secondary packaging 120 is received within the primary packaging 110. FIG. 1C further illustrates sample adjunct materials 104 held within the secondary package 120. The adjunct materials 104 may be consumable materials associated with the primary contents 102. As one possibility, the primary content 102 may be an appliance, such as a beverage machine, and the adjunct materials 104 may be beverage pods, cartridges, capsules, and/or other structures that are used to facilitate one or more operations of the beverage machine, such as brewing or otherwise forming a beverage. The adjunct material 104 may have a short shelf life, such as a period of months, and thus it is advantageous to include the adjunct materials 104 within the primary packaging 110 in relative proximity to a point of sale, rather than a point of manufacture.

As shown in FIG. 1C, the secondary packaging 120 is received within the primary packaging 110 while the primary access flaps 114 remain closed. As shown in FIG. 1C, a position or orientation of the primary contents remain undisturbed despite the addition of the secondary packaging 120. As such, the secondary packaging 120 can be added to the primary packaging 110 at a time substantially after the initial assembly and packaging of the primary contents 102, thereby helping maximize a possible shelf live for the adjunct materials inserted into the primary packaging 110 In this manner, the primary packaging 110 can maintain a position, orientation, assembled stated, and so forth while the secondary packaging 120 is inserted. Further, the secondary packaging 120 is inserted into the primary packaging 110 while the primary access flap 114 and/or other flap covering a primary opening remains closed.

Figure 2:
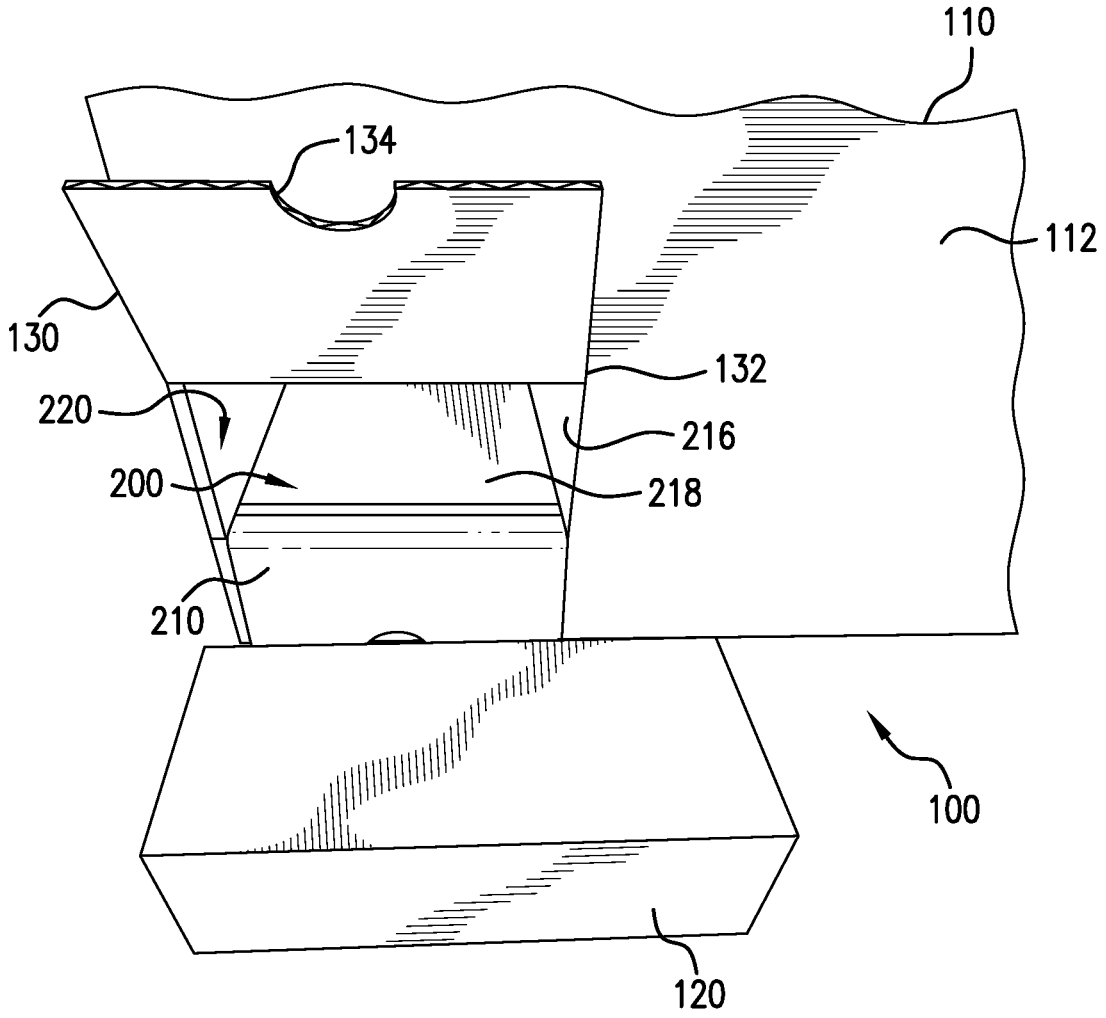
FIG. 2 depicts a perspective view of an opening feature formed in the primary packaging.

FIG. 2 is a perspective view of the opening feature 130 formed in the primary packaging 110. In the example of FIG. 2, the opening feature 130 is a hinged door, shown in an open configuration. When in an open configuration, the opening feature 130 is at least partially separated from a remainder of the wall of the primary packaging 110. The opening feature 130 can then articulate along a hinged edge 132 that is not perforated, and thus not separated from the primary packaging 110. The hinged edge 132 may include a formed relief, a reduced amount of material, or another hinge feature to facilitate the hinging motion. Alternatively, the material used to form the primary packaging 110 may be sufficiently weak to create a bending site at the hinged edge 132 when a bending force is exerted on the opening feature 130.

To facilitate separating the hinged door from the remainder of the wall 112 of the primary packaging 110, a digit engagement feature 134 may be formed along a free edge. The digit engagement feature 134 includes a small cutout forming a recess in the hinged door. The digit engagement feature 134 allows for a user's finger to engage the door and provide sufficient force to break the connections between the perforations, allowing the door to bend and hinge upon its at least one connected edge (e.g., hinged edge 132), thereby allowing access to the internal portion of the primary packaging 110. While the digit engagement feature 134 is illustrated as a small cutout or recess, any number of engagement features may be used, including, but in no way limited to, a tab, a mating feature, and the like.

According to one embodiment, the opening feature 130 is configured to be a hinged door re-closeable after the bending motion, allowing for the closure and sealing, for example, of the door. Closure of the opening feature 130 may be secured by an interference engagement between the edge of the opening feature 130 and the mating perforated edges of the primary packaging 110. Alternatively, another engagement feature can be formed to ensure closure. Furthermore, an adhesive or a sealing member may be used to securely close the opening feature 130 to the primary packaging 110 after use.

As illustrated in FIG. 2, the primary package 110 may include an internal compartment 200. The internal compartment 200 may be configured to receive the secondary packaging 120. For example, the internal compartment 200 may be defined by various internal shelves, walls, partitions, dividers, supports, and so on that support the secondary packaging 120, including constraining movement of the secondary packaging 120 within the interior space of the primary packaging 110. In this manner, the interior space of the primary packaging 110 may have a dedicated, or even isolated, portion reserved for the secondary packaging 120;

however, this is not required. As described herein, the secondary packing 120 (or adjunct materials more generally) may be advanced into the interior space loosely and/or without constraint inside of the internal space of the primary packaging 110.

According to one exemplary embodiment, the internal compartment 200 is at least partially defined by a plurality of internal compartment walls 220. As shown, the internal compartment walls 220 can form or define the internal compartment 200, separating the adjunct or sample materials or the secondary packaging 120 from the appliance or other elements contained within the primary packaging 110. This separation can protect (e.g., define a protective barrier about) the adjunct or sample materials or the secondary packaging 120 during subsequent shipping, transport, or distribution.

FIG. 2 also depicts other sample internal features that may facilitate receiving the secondary packaging 120 within the interior space of the primary packaging 110. For example, FIG. 2 illustrates an internal feature 218 and an internal shelf 218. In one embodiment, the internal feature 218 may help separate the adjunct materials from the primary contents, such as an appliance, held within the primary packaging 110. The internal feature 216 may therefore, along with other internal features or walls of the primary packaging, define a dedicated space for the adjunct materials within the primary packing 110. In turn, this may allow the primary packaging 110 to maintain a position or orientation of the primary contents (e.g., the primary contents may remain substantially undisturbed), notwithstanding the presence or absence of the secondary packaging 120, or associated adjunct materials.

The internal shelf 218, along with other internal features of the primary packaging 110 may also help receive and secure the secondary packaging 120 within the interior space. For example, the internal shelf 218 may provide a platform or internal support, upon which the secondary packaging 120 may slide onto and rest within the primary packaging 110.

As described herein, the secondary packaging 120 may fit snuggly or securely within the primary packaging. In one embodiment, one or more of the internal compartment walls 220, internal feature 216, internal shelf 218, and/or other feature may establish a friction fit with the secondary packaging 120. The friction fit may operate to restrain movement of the secondary packaging 120 within the primary packaging 110, which may facilitate subsequent transport and sale activities.

According to one exemplary embodiment, the internal compartment walls 220, internal feature 216, internal shelf 218, and so on are assembled and coupled to the internal surface of the primary packaging 110 during assembly of the primary packaging 110. Coupling techniques include using any number of adhesives, fasteners, or assembly methods, including, but in no way limited to, glue, staples, and the like.

Additionally, as shown in FIG. 2, the primary packaging 110 may include an internal door 210. The internal door 210 may be formed from one or more walls 112 of the primary packing. In some cases, the internal door 210 formed through an interior surface of the primary packaging 110 (e.g., using perforations) or as part of the internal compartment structural walls 220. As shown, the internal door 210 provides an additional structural wall or surface defining the internal compartment 200.

When assembled, the internal door 210 can mate with the hinged perforated door 130. According to one exemplary embodiment, the internal door 210 is formed as part of an interior wall of the primary packaging 110 and processed to include perforations similar to the hinged door defined by the opening feature 130. Alternatively, the internal door 210 can be a floating hinged flap that is not structurally connected to either an internal layer of the primary packaging 110 or the internal compartment walls 220. Moreover, similar to the hinged door of the opening feature, the internal door 210 can include a hinged surface that may include a formed relief, a reduced amount of material, or another hinge feature to facilitate the hinging motion. Alternatively, the material used to form the internal door 210 may be sufficiently weak to create a bending site at the hinged edge when a bending force is exerted on the internal door 210.

Figure 3:
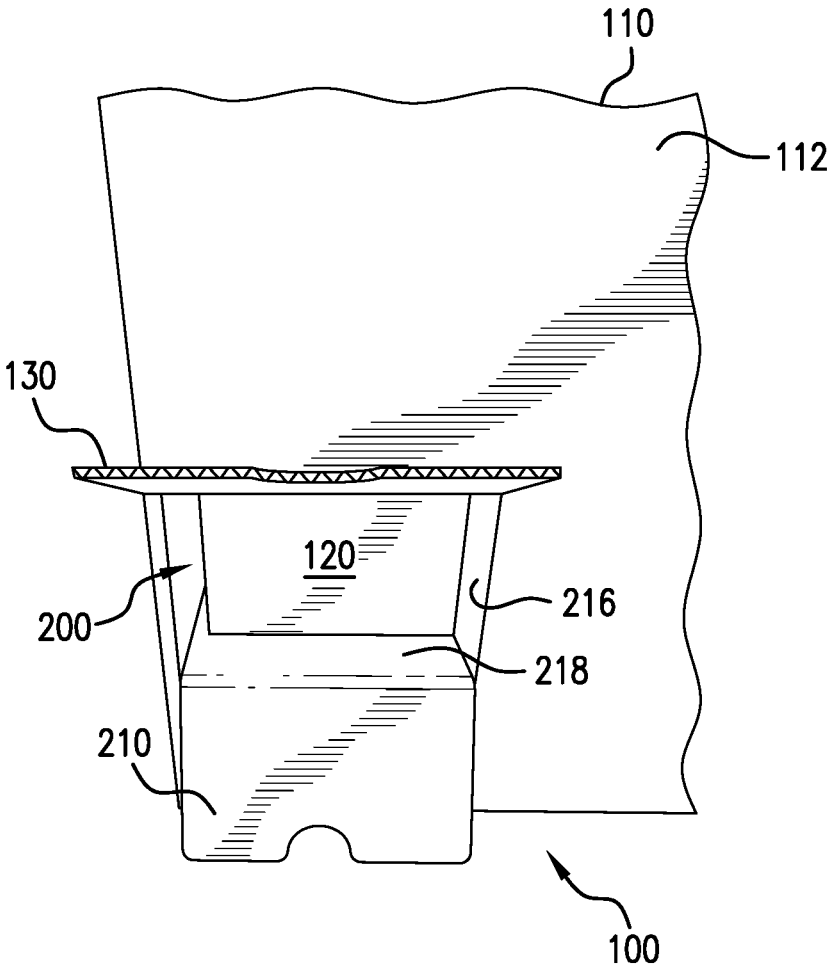
FIG. 3 depicts a perspective view of a secondary packaging inserted into the primary packaging through the opening feature formed in the primary packaging.

FIG. 3 is a perspective view of the secondary packaging 120 inserted into the primary packaging 110 through the opening feature formed in the primary packaging 110, according to an embodiment. As illustrated, the wall 112 includes a secondary opening and the secondary packaging 120 passes through the secondary opening. The opening feature 130, internal door 210, and/or other feature of mechanism, may cover the secondary opening. In the configuration shown in FIG. 3, the opening feature 130 and internal door 210 are articulated to a position that exposes the secondary opening, and allows for insertion of the secondary packaging 120 into the internal compartment 200.

For example, the secondary packaging 120 may slide into the internal compartment 200. Within the internal compartment 200, the secondary packaging 120 may rest or otherwise be supported by the internal shelf 218, the structural walls 200, the internal feature 216, and/or other structures of the primary packaging 110. In the position illustrated in the example of FIG. 3, the secondary packaging 120 may be protected from engagement with the appliance or other primary contents of the primary packaging 110. As shown, the secondary packaging 120 slides completely into the internal compartment 200, and leaves sufficient space for the various engagement features, doors, and so on to enclose the secondary packaging 120 within the primary packaging 110.

Figure 4:
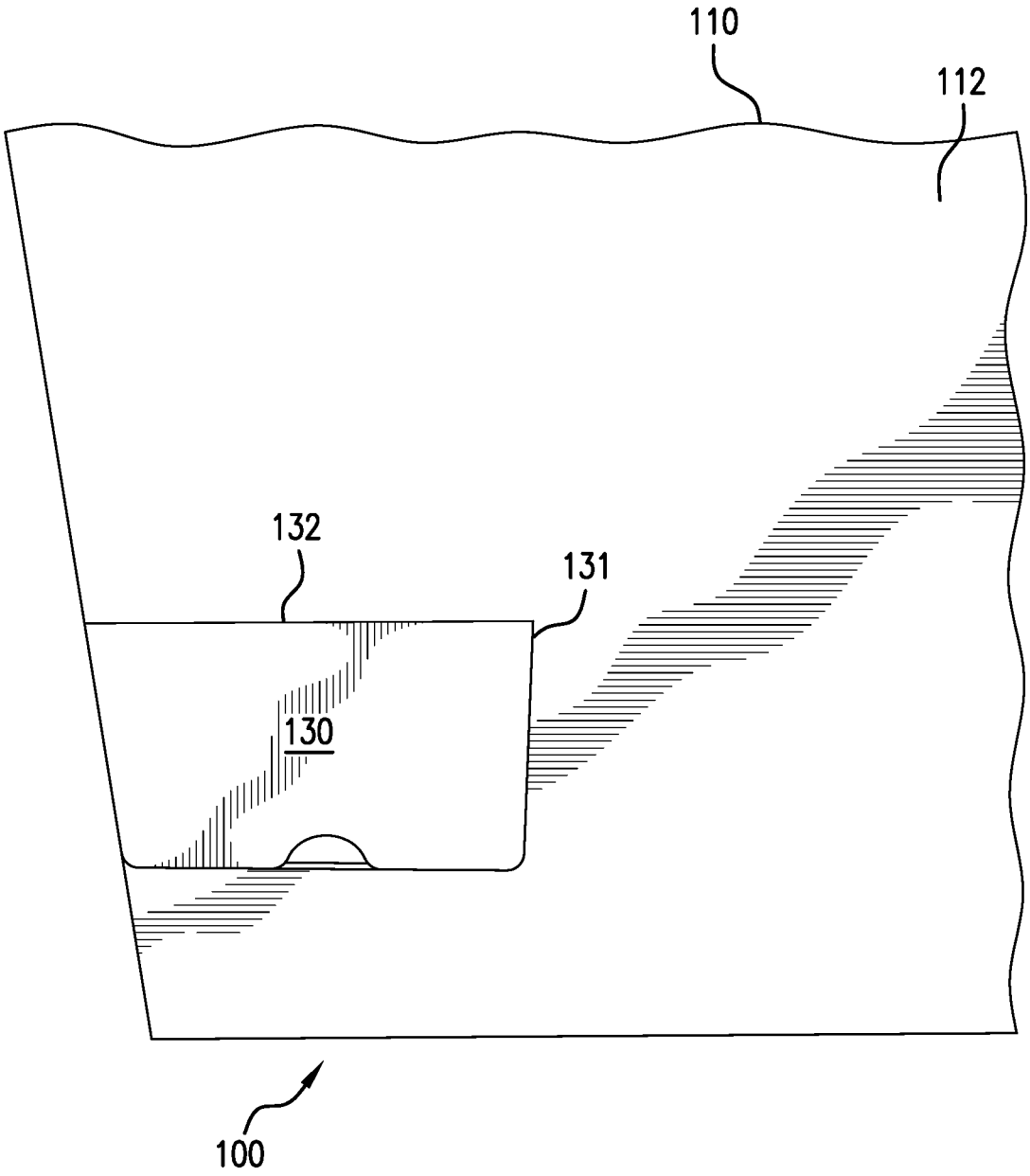
FIG. 4 depicts a perspective assembled view of a secondary packaging inserted into and enclosed by the primary packaging.

FIG. 4 is a perspective assembled view of the secondary packaging 120 inserted into the primary packaging 110, according to an embodiment. As illustrated, the opening feature 130 and the internal perforated door 210 are articulated to enclose the secondary packaging 120 within the primary packaging 120. In some cases, such as that shown in FIG. 4, the opening feature 130 may be flush with an outer surface of the walls 112. In this manner, the primary packaging 110 may maintain a consistent profile around an outer surface.

Figure 5:
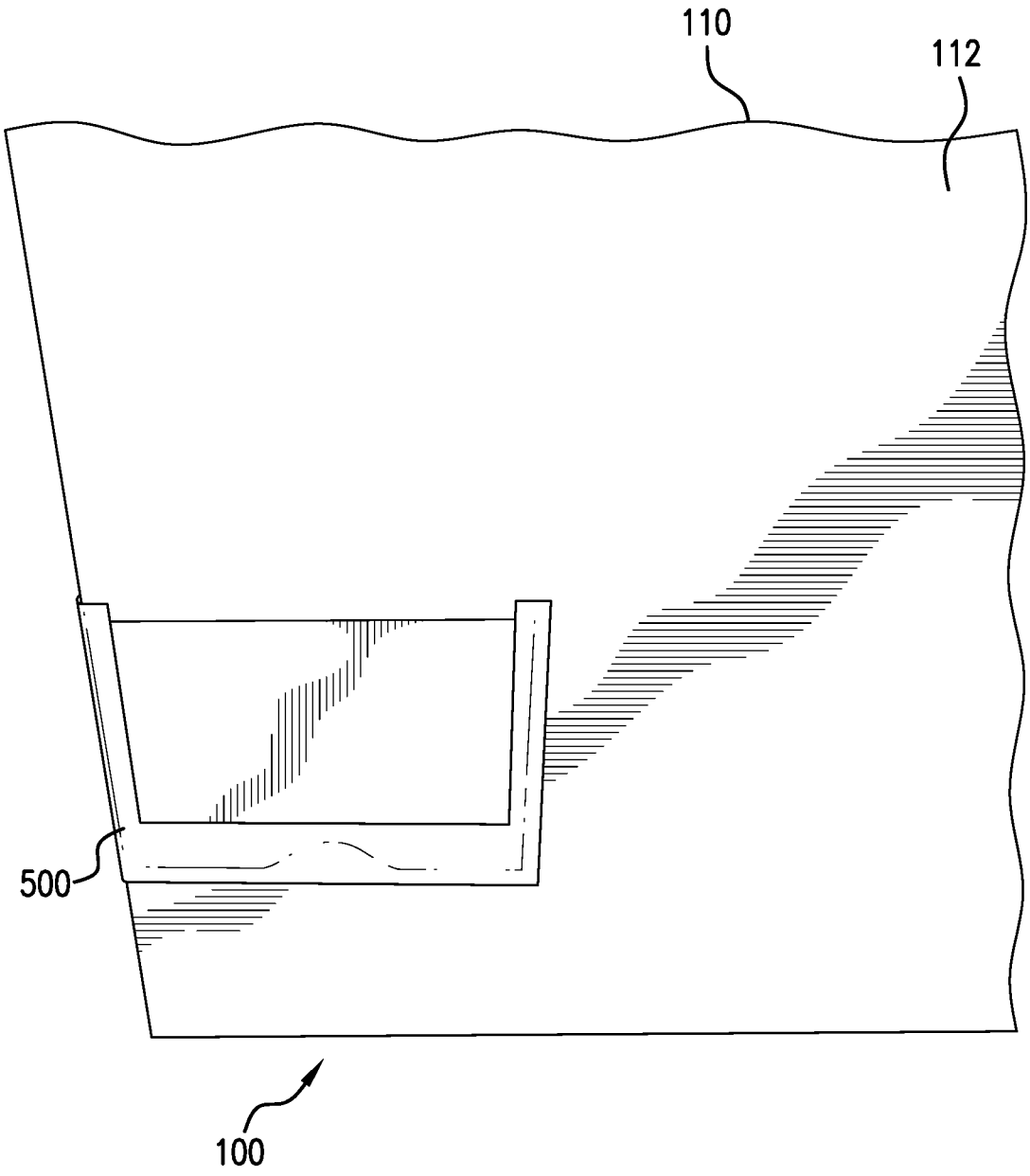
FIG. 5 depicts a perspective assembled view of a secondary packaging inserted into and sealed by a tamper-resistant sealer within the primary packaging.

FIG. 5 is a perspective assembled view of a secondary packaging 120 inserted into and sealed by a tamper-resistant sealer 500 within a primary packaging 110, according to an embodiment. As shown, the tamper-resistant sealer 500 covers the interface between the hinged perforated door 130 and the outer surface of the primary packaging 110. The tamper-resistant sealer 500 can be any adhesive or sealing member configured to seal the interface and secure the secondary packaging 120 within the internal compartment 200 including, but in no way limited to, glue, a sticker, tape, staples, and the like. According to one exemplary embodiment, the sealant comprises tamper-resistant tape that visibly demonstrates when it has been tampered with by physically and catastrophically tearing, mismatching patterns or letters, changing color, etc.

Figure 6:
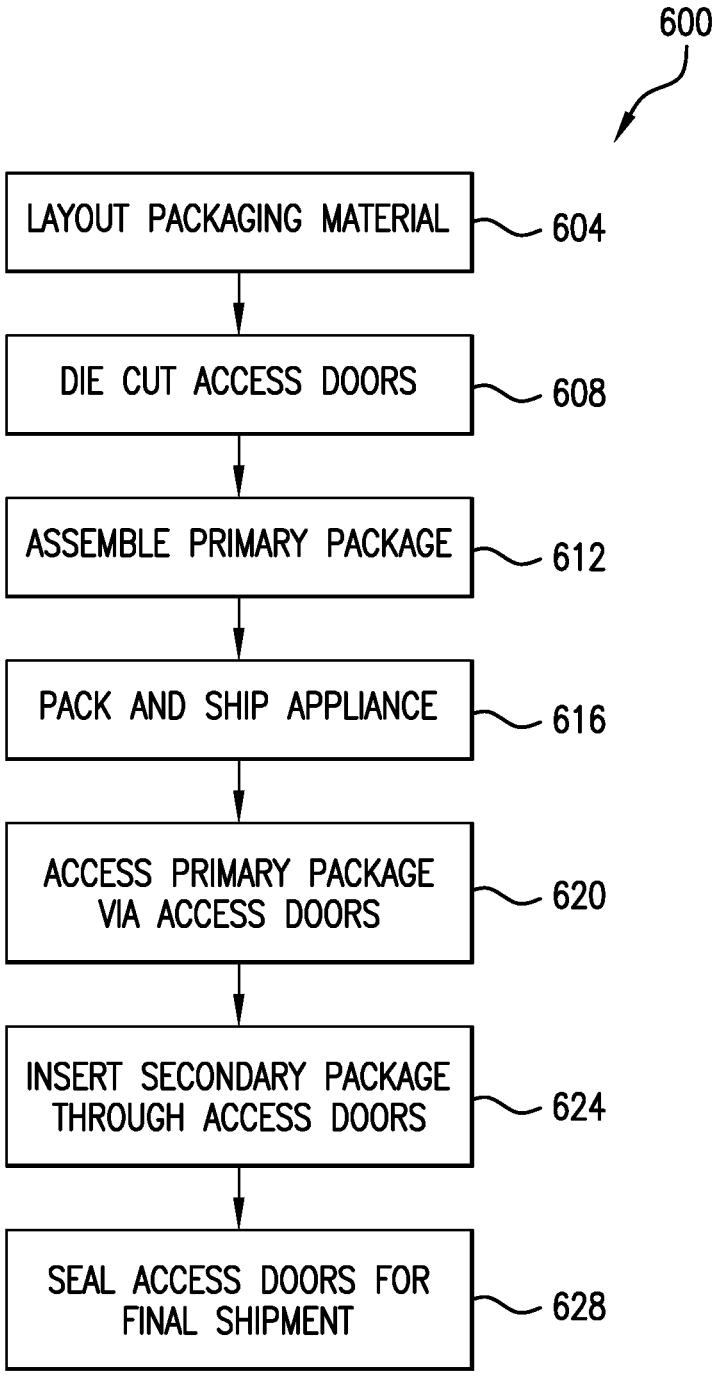
FIG. 6 depicts a flow diagram for assembling a package.

To facilitate the reader's understanding of the various functionalities of the embodiments discussed herein, reference is now made to the flow diagram in FIG. 6, which illustrates process 600. While specific steps (and orders of steps) of the methods presented herein have been illustrated and will be discussed, other methods (including more, fewer, or different steps than those illustrated) consistent with the teachings presented herein are also envisioned and encompassed with the present disclosure.

In this regard, with reference to FIG. 6, process 600 relates generally to methods of assembling a package. The method 600 may be used with any of the packages, packaging, packaging systems, and so on, described herein, for example, such as the packaging system or package 100, the primary packaging 110, the secondary packaging 120, and variations and embodiments thereof.

At operation 604, packaging material may be laid out. The packaging material may be pre-cut into a desired pattern to form the primary packaging 110, or the packaging material may be customized to form the desired primary packaging. For example and with reference to FIG. 1A, corrugated material, or other packaging materials, may be cut in a pattern in order to form the walls 112.

At operation 608, access doors may be die cut. For example and with reference to FIG. 2, an opening feature 130, an internal door 210, or other feature may be cut into the walls 112. In some cases, this may involve forming the perforations 131 through a thickness of the walls, and a user may subsequently separate a hinged door for a remainder of the wall. As noted above, the access doors may be cut by any number of manufacturing methods, including die-cutting, stamping, laser-cutting, and the like. Additionally, as mentioned above, the access doors may be formed after assembly of the primary packaging 110.

At operation 612, the primary packaging may be assembled, including coupling the outer walls of the primary packaging 110. For example and with reference to FIG. 2, internal walls 200, internal features 216, internal shelves 218, and so on may be connected to various surfaces within the primary packaging 110. Such features may define a dedicated space for the secondary packaging 120 within the primary packaging 110, thereby allowing the secondary package 120 to be inserted into the primary package 110 without disturbing primary contents held therein. According to one embodiment, the internal compartment 200 can be coupled to the primary packaging 110 during assembly, including the internal perforated door 210.

At operation 616, the appliance can then be packaged in the primary packaging. Subsequently, the primary packaging can then be shipped (with the primary contents or appliance) from the primary manufacturing assembly.

In this regard, a primary packaging may be provided so that at operation 616, primary contents may be packaged therein. For example, and with reference to FIGS. 1A and 2, a primary packaging 110 may be provided having a primary access flap and an opening feature. The opening feature allows for insertion of a secondary packaging into an interior defined by the primary packaging, while the primary access flaps remain closed.

Accordingly, operation 616 may involve packaging primary contents with the primary package. For example and with reference to FIG. 1B, primary contents 102 may be packaged within the interior space 101 of the primary packaging 110. The primary contents 102 may be held within the interior space 101 of the primary packaging 110, for example, by an internal feature 116 and/or other elements, such as other packaging materials, foams, cushions, wrapping, fillers, and so on. When the primary contents 102 are packaged within the primary package 110, the primary access flap 114 may be closed, thereby sealing the primary contents 102 within the primary packaging for shipment or other subsequent packaging processing.

At operation 620, the primary package may be received at a secondary location. At the secondary location, an interior of the primary packaging may be accessed via access doors. For example and with reference to FIG. 2, the opening feature 130 may be articulated to uncover or reveal a secondary opening formed through a wall 112 of the primary packaging.

At operation 624, secondary items are inserted into the interior space of the primary packaging. This occurs without opening a primary access flap and/or otherwise disturbing primary contents of the primary packaging. For example and with reference to FIG. 3, the secondary packaging 120 (or loosely assembled) secondary packages, samples, components and/or perishable items may be inserted into the interior space of the primary packaging 110, including in some embodiments, into the internal compartment 200.

At operation 628, the secondary packaging and associated adjunct materials may be sealed within the primary packaging. For example and with reference to FIG. 5, a tamper-resistant tape, such as the sealer 500 may be adhered to and around an area of the wall 112 having the opening feature 130. In some cases, this may include an adhered label or overseal, which may help to deter pilferage/theft. The package may then be shipped to other distributors, points of sale, or consumers.

Other examples and implementations are within the scope and spirit of the disclosure and appended claims. For example, features implementing functions may also be physically located at various positions, including being distributed such that portions of functions are implemented at different physical locations. Also, as used herein, including in the claims, "or" as used in a list of items prefaced by "at least one of" indicates a disjunctive list such that, for example, a list of "at least one of A, B, or C" means A or B or C or AB or AC or BC or ABC (i.e., A and B and C). Further, the term "exemplary" does not mean that the described example is preferred or better than other examples.

The foregoing description, for purposes of explanation, uses specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A package, comprising:

a primary packaging including:

walls that define an interior space configured to hold primary contents; and a primary access flap that is configured to enclose the primary contents within the interior space;

an opening feature defined by at least one wall of the primary packaging and configured to provide access to the primary contents for packing adjunct materials with the primary contents within the interior space, wherein the opening feature is configured to provide access to the interior space for the adjunct materials while the primary packaging maintains:

the primary access flap in a closed position; and a position or orientation of primary contents held within the interior space; and an internal compartment connected to the opening feature and configured to constrain movement of the adjunct materials within the interior space.

2. The package of claim 1, wherein the opening feature comprises a hinged door configured to articulate over a secondary opening defined in an outer surface, the secondary opening configured to receive the adjunct materials.

3. The package of claim 2, wherein the internal compartment is connected to the secondary opening and comprises a support that separates the adjunct materials from the primary contents while maintaining the access to the primary contents provided by the opening feature.

4. The package of claim 3, wherein:

the adjunct materials are arranged within a secondary packaging; and the internal compartment is configured to secure the secondary packaging within the interior space by a friction fit.

5. The package of claim 1, wherein:

the primary contents are an appliance comprising a beverage machine; and the adjunct materials are perishable materials associated with an operation of the beverage machine.

6. The package of claim 1, further comprising the primary contents.

7. The package of claim 1, wherein the primary packaging is formed from a corrugated material.

8. A method for assembling a package, comprising:

providing the primary packaging of claim 1;

packaging primary contents with the primary packaging at a predetermined orientation by:

inserting the primary contents into the interior space through the primary access flap; and sealing the primary access flap; and packaging adjunct materials with the primary package by inserting the adjunct materials into the interior space through the opening feature while maintaining the predetermined orientation of the primary contents within the interior space.

9. The method of claim 8, further comprising sealing the opening feature using tamper-resistant tape.

10. The method of claim 8, wherein the adjunct materials comprise perishable materials used in production of a beverage.

11. The package of claim 1, further comprising a tamper-resistant seal for sealing an interface between the opening feature and the walls of the primary packaging.

12. The package of claim 11, wherein the tamper-resistant seal comprises a tamper-resistant tape configured to destructably and visibly demonstrate a tampering of the tamper-resistant seal along the interface.

13. A package, comprising:

walls formed from a corrugated material and defining an interior space configured to hold primary contents;

a primary access flap enclosing a primary opening of the interior space;

at least one wall defining:

a secondary opening in an outer surface extending into the interior space; and a hinged door covering the secondary opening, wherein the interior space is arranged to receive a secondary packaging including adjunct materials through the secondary opening, the interior space further arranged to separate the adjunct materials from the primary contents held within the interior space;

a shelf arranged within the interior space for holding the secondary packaging thereon; and a filler material on the shelf and defining a dedicated space for the secondary packaging adjacent and accessible with the primary contents, wherein the shelf and filler material collectively define an internal feature of the package for constraining movement of the secondary packaging received through the secondary opening while the primary contents remain undisturbed.

14. The package of claim 13, wherein the shelf defines a friction fit with the secondary packaging received through the secondary opening, thereby limiting movement of the secondary packaging relative to the primary contents held within the interior space.

15. The package of claim 13, wherein the hinged door is defined by perforations formed through the at least one wall.

16. The package of claim 15, wherein the hinged door is configured to separate from a remainder of the at least one wall along the perforations.

17. The package of claim 15, wherein the hinged door defines a digit engagement feature configured for manipulation of the hinged door.

18. The package of claim 13, wherein the interior space is configured to hold primary contents in a predetermined orientation.

19. The package of claim 18, wherein the predetermined orientation of the primary contents is maintained when adjunct materials are received through the secondary opening.

* * * * *